US010661118B2

(12) United States Patent
Wilson

(10) Patent No.: US 10,661,118 B2
(45) Date of Patent: May 26, 2020

(54) PERFECT SQUAT

(71) Applicant: DiJon X. Wilson, Mesquite, TX (US)

(72) Inventor: DiJon X. Wilson, Mesquite, TX (US)

( * ) Notice: Subject to any disclaimer, the term of this patent is extended or adjusted under 35 U.S.C. 154(b) by 0 days.

(21) Appl. No.: 15/814,388

(22) Filed: Nov. 15, 2017

(65) Prior Publication Data

US 2019/0143176 A1 May 16, 2019

(51) Int. Cl.

| | |
|---|---|
| ***A63B 69/00*** | (2006.01) |
| ***A63B 24/00*** | (2006.01) |
| ***A63B 21/00*** | (2006.01) |
| ***A63B 71/06*** | (2006.01) |
| ***A63B 23/035*** | (2006.01) |
| *A63B 23/04* | (2006.01) |

(52) U.S. Cl.

CPC .... *A63B 24/0062* (2013.01); *A63B 21/00043* (2013.01); *A63B 21/00185* (2013.01); *A63B 21/00196* (2013.01); *A63B 21/4011* (2015.10); *A63B 23/0355* (2013.01); *A63B 24/0003* (2013.01); *A63B 69/0059* (2013.01); *A63B 71/0619* (2013.01); *A63B 2023/0411* (2013.01); *A63B 2024/0065* (2013.01); *A63B 2069/0062* (2013.01); *A63B 2071/0625* (2013.01); *A63B 2071/0627* (2013.01); *A63B 2071/0652* (2013.01); *A63B 2071/0655* (2013.01); *A63B 2071/0661* (2013.01); *A63B 2209/00* (2013.01); *A63B 2209/10* (2013.01); *A63B 2220/16* (2013.01); *A63B 2220/17* (2013.01); *A63B 2220/24* (2013.01); *A63B 2220/833* (2013.01); *A63B 2220/836* (2013.01); *A63B 2225/09* (2013.01); *A63B 2225/50* (2013.01)

(58) Field of Classification Search

USPC ..... 434/247, 250, 253, 255, 258; 340/573.1, 340/573.7; 482/8, 9, 148

See application file for complete search history.

(56) References Cited

U.S. PATENT DOCUMENTS

| | | | | |
|---|---|---|---|---|
| 2,895,471 A * | 7/1959 | Rollie | A41B 13/00 | 128/882 |
| 4,665,388 A * | 5/1987 | Ivie | A63B 24/00 | 200/DIG. 2 |
| 4,747,779 A * | 5/1988 | Gerstung | A63B 21/0004 | 128/882 |
| 4,938,476 A * | 7/1990 | Brunelle | A63B 23/0244 | 340/573.7 |
| 4,958,145 A * | 9/1990 | Morris | G08B 21/0446 | 340/573.1 |

(Continued)

*Primary Examiner* — Kurt Fernstrom

(57) ABSTRACT

A device and method for monitoring and tracking the body movement of a user performing regular exercises such as squat is disclosed. The device for monitoring and tracking the body movement comprises a thigh strap, a housing and a printed circuit board. The printed circuit boards attached with the thigh straps comprises an actuating device, an accelerometer, a communication link, a power source, a processor, an USB connector, and an alerting device. The device senses accurate squat position and indicate with an audible beep, LED display, or it can be switched to a vibration mode. The device is configured to hold the legs and indicate the accurate squat position. The device could also connected to various other devices via Bluetooth linking technology.

18 Claims, 8 Drawing Sheets

(56) References Cited

U.S. PATENT DOCUMENTS 4,984,786 A * 1/1991 Lemke ..... A63B 21/4001 482/105
5,158,520 A * 10/1992 Lemke ..... A63B 21/06 482/103
5,362,305 A * 11/1994 Varn ..... A61F 5/0193 128/882
5,394,888 A * 3/1995 Stone ..... A61B 5/1071 340/573.7
5,718,672 A * 2/1998 Woodman ..... A61F 5/0193 602/23
6,416,448 B1 * 7/2002 Hassler ..... A61H 1/024 482/113
6,585,672 B1 * 7/2003 Crompton ..... A61F 5/0193 128/869
6,834,436 B2 * 12/2004 Townsend ..... A61B 5/1116 33/341
7,166,083 B2 * 1/2007 Bledsoe ..... A61F 5/0116 602/23
7,967,738 B2 * 6/2011 Dauterive ..... A61H 1/024 482/145
7,981,057 B2 * 7/2011 Stewart ..... A41D 13/02 600/595
8,038,549 B2 * 10/2011 Vann ..... A63B 69/0071 473/422
8,149,126 B2 * 4/2012 Little ..... G06Q 40/08 340/540
8,284,070 B2 * 10/2012 Chaudhari ..... G01C 9/00 340/573.1
8,436,737 B1 * 5/2013 Trout ..... A61B 5/1116 340/573.1
8,551,027 B2 * 10/2013 Endo ..... A61H 3/00 128/846
8,827,873 B2 * 9/2014 Arnstein ..... A61H 1/0266 482/79
8,840,527 B2 * 9/2014 Zhang ..... A61B 5/4595 482/8
8,849,697 B2 * 9/2014 Tropper ..... A61B 5/1118 705/14.22

* cited by examiner

PERFECT SQUAT

BACKGROUND OF THE INVENTION

A. Technical Field

The present invention generally relates to a device, system and method for monitoring and tracking the body movement of a user performing regular exercises such as squat. Further, the system proposes a diagnostics tool for the user to perform the squat exercise accurately without the help of a personal trainer or a spotter to correct the body movement.

B. Description of Related Art

Exercise has been proven one of the most health beneficial activities that humans can engage in. With the introduction of modern technology, lack of exercise has become a persistent problem. With each passing decade the sedentary lifestyle is becoming much more commonplace and along with it the associated diseases, the gaining of weight and other consequences of a non-active lifestyle are the results. Automobiles, long hours in front a computer and television are just some of the modern conveniences that are wonderful at fulfilling leisure time but also are contributing to the lack of exercise the contemporary individual is experiencing. Injecting exercise into the prevailing lifestyle is sometimes difficult and finding the time without diminishing the current quality of life is always a challenge. This is one of the reason that when we do exercise it is important to be assured the exercising we accomplish is done properly and effectively. Nothing is more frustrating to work hard at something only to see no result or the wrong results.

Modern exercise machines are suitable for providing workouts specifically designed to tone and strengthen the body. These machines tend to be very expensive and can take up an enormous amount of space in a personal residence, and since many machines target only certain parts of the body, several machines might be required. One solution is to use a gym or recreational center. Gym or exercise centers can be expensive and require even more time out of a person's day since they are located away from the home. Additional problems arise when these exercise centers are busy and time can be spent waiting for certain machines. Machines are wonderful accessories to a daily or weekly exercise routine, which are helpful for a good physical workout. A person can perform an exercise at home or anywhere they wish simply by following a suitable regimented routine. Small machines keep track of a particular physical exercise are designed for specific target areas and are proving to be exceptionally useful to the personal exercise regimen. Exercise for some target areas can be extremely difficult to know when the best technique is applied.

The 'squat' is a common form of exercise for a total lower body workout and requires a minimum of equipment. The benefits of the squat exercises are, but not limited to, engaging the quadriceps, the hamstrings, and the calf muscles, and provides a powerful workout to the gluteus maximus (butt) muscles. Further, it engages the core muscles and tends to flatten the abdomen, and increases joint flexibility in the ankles, knees, hips, and lower back. Moreover, it engages the muscles of the upper body, providing a full body workout by employing hand weights or bar bells during squat exercise.

However, performing the squat exercise properly is difficult without a spotter or professional trainer observing the thigh position during each repetition. Not achieving the correct thigh position reduces the maximum benefit from the exercise. There are other positioning factors as well. The optimum body position is difficult to maintain over the course of the exercise, the thigh angle is difficult to obtain accurately each repetition, and the legs tend to separate as the exercise repetition count increases. These problems, and others, creep in overtime to reduce the benefit of the exercise.

The body squat is a very beneficial exercise but the perfect form is very difficult to achieve. The ideal squat is a precise type of movement that can be hard to distinguish correctly without the help of a personal trainer to correct the movement. The human body has difficulty positioning itself and the person doing the exercise has a challenging time recognizing when the squat is done correctly.

Therefore, there is a need for a device, system and method for monitoring and tracking the body movement of a user performing squat exercises.

SUMMARY OF THE INVENTION

The present invention is related to a device, system and method for monitoring and tracking the body movement of a user performing regular exercises such as squat. In an embodiment, the device for monitoring and tracking the body movement comprises a thigh strap, a housing and a printed circuit board (PCB). The printed circuit boards (PCB) comprises an actuating device, an accelerometer or a gyroscope, a communication link, a power source, a processor, an USB connector, and an alerting device. In one embodiment, the actuating device is one or more power and reset switches. In one embodiment, the communication link is a Bluetooth communication link. In one embodiment, the power source is a replaceable or a rechargeable battery. In one embodiment, the processor is a microcontroller chip, and the alerting device is one or more of digital display, vibration motor, Alert LEDs or speaker.

In an embodiment, the thigh straps are prepared by cutting to a required dimension of nylon fabric using a computer controlled rolling cutter. After cutting, the fabric is edged using nylon edging which is sewn into place around the strap to create designer look. The edging can complement, match, or contrast with the strap color to enhance the 'look'. The nylon strap retainer is sewn to the inner thigh point using a 1" wide woven nylon strap and commercial plastic strap retainer. A side-release buckle receiver is sewn to the inner thigh point on the other strap using a 1" wide woven nylon strap to accept the side release buckle on the adjustable leg separation strap. After sewing, an electronic housing is attached, two thigh straps are joined using the buckle and packed for shipment in the point-of-sale packaging.

In one embodiment, the housing for controller are injection molded from polycarbonate plastic. This plastic is very durable, is highly resistant to drop shocks, household and gymnasium chemicals, which is also easy to clean. The housing can be supplied in almost any vibrant color, so a distinctive color may be chosen to enhance the product recognition factor, which can dramatically improve the market adoption of the product. The housing comprises two sections, which could snap together to protect the electronics, and retained using stainless steel fasteners. The assembled and tested housing is secured to the thigh strap using aluminum rivets.

In one embodiment, the PCB for the controller is fabricated to the final design requirements. The standard thickness, double-sided circuit board material is populated with surface mounted components. Any through-hole devices are inserted after the surface mounted assembly, soldering, and cleaning. The circuit board is designed to have all the components oriented so they can be mounted with the LED illuminators projecting out of the lenses mounted in the housings. After assembly, the PCBs are protected with a moisture adsorption preventive conformal coating.

In an embodiment, the power and reset switches are sealed tactile membrane switches to have a prominent product life cycle. In one embodiment, accelerometer and gyroscope is a chip measuring the angle from erect, and the thigh strapped with the controller reaches 90° from vertical and parallel to the floor, the controller engages the alert function. The accelerometer and gyroscope work in tandem to optimize the motion discrimination.

In an embodiment, the Bluetooth communication link is a chip allowing bi-lateral communication with an electronic device such as smartphone or wireless headphones/ear buds. It sends alert signals to the appropriate linked device selected by the user. In one embodiment, the controller is operated using four AA batteries. In one embodiment, the microcontroller chip is a microprocessor with 1 GHz snapdragon or equal. In one embodiment, the USB connector allows the user to cable a laptop to the exercise controller for updates as they become available or to reprogram the device.

In an embodiment, the digital display is a liquid crystal device with a backlight and a monochromatic display. In one embodiment, vibration motor is an offset weighted DC motor. It operates at 11,000 RPM and creates a very distinctive vibration, which is transmitted directly to the outer thigh when the optimum angle is obtained. In one embodiment, the alert LEDs are placed to project from PCB out through the polycarbonate lenses in the controller housing. In an embodiment, the speaker comprises a digital to analog converter, allows the controller to produce a tone, other sounds, or even synthesized words as an alerting function.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
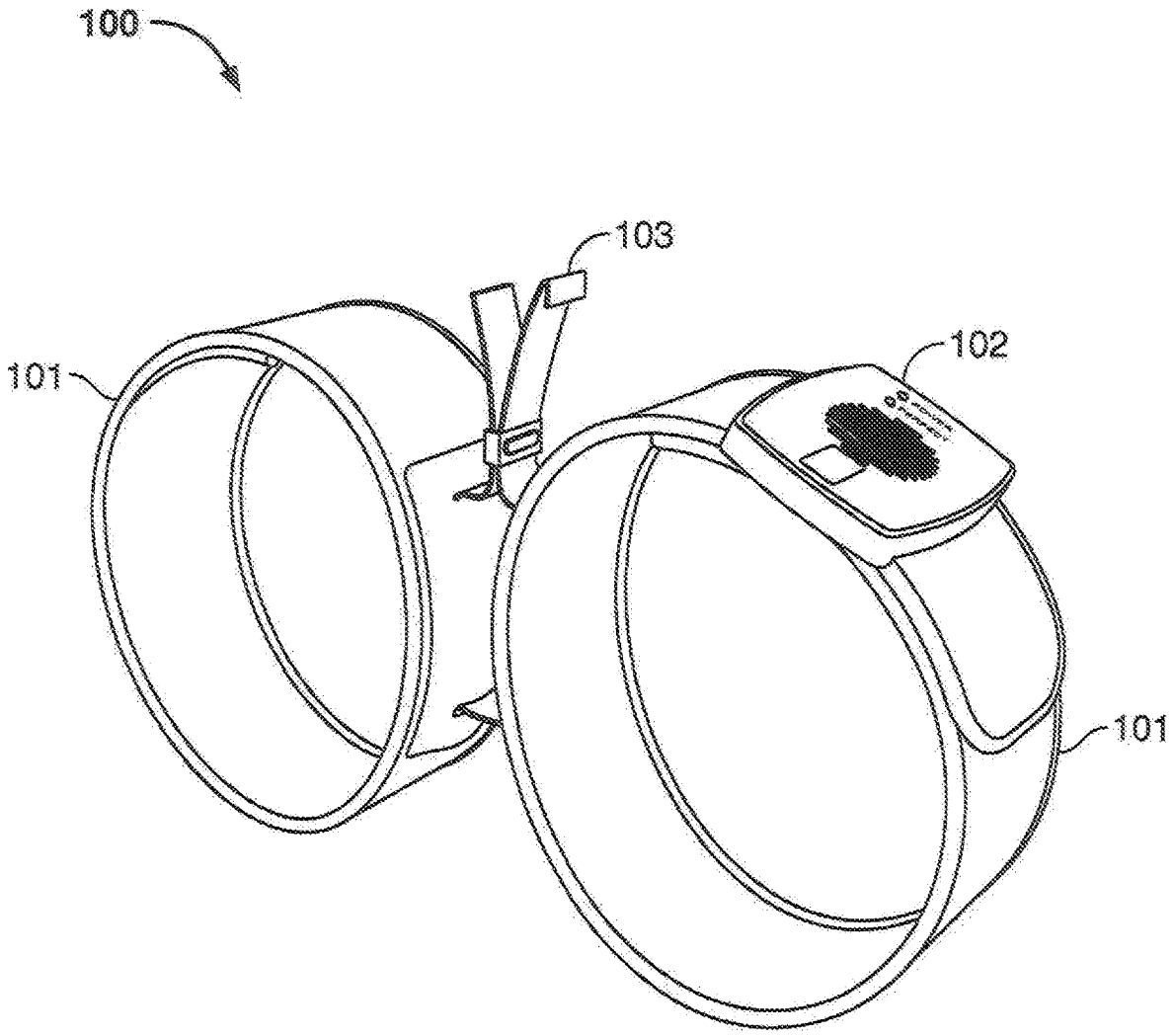
FIG. 1 shows a schematic view of the device for monitoring and tracking the body movement of a user performing squat exercises according to an embodiment.

The embodiments herein relates to device, system and method for monitoring and tracking the body movement of a user performing regular exercises such as squat. FIG. 1 shows a schematic view of the device 100 for monitoring and tracking the body movement of a user performing squat exercises according to an embodiment. The device 100 is designed to aid the individual in doing the perfect squat exercise technique.

Figure 2A:
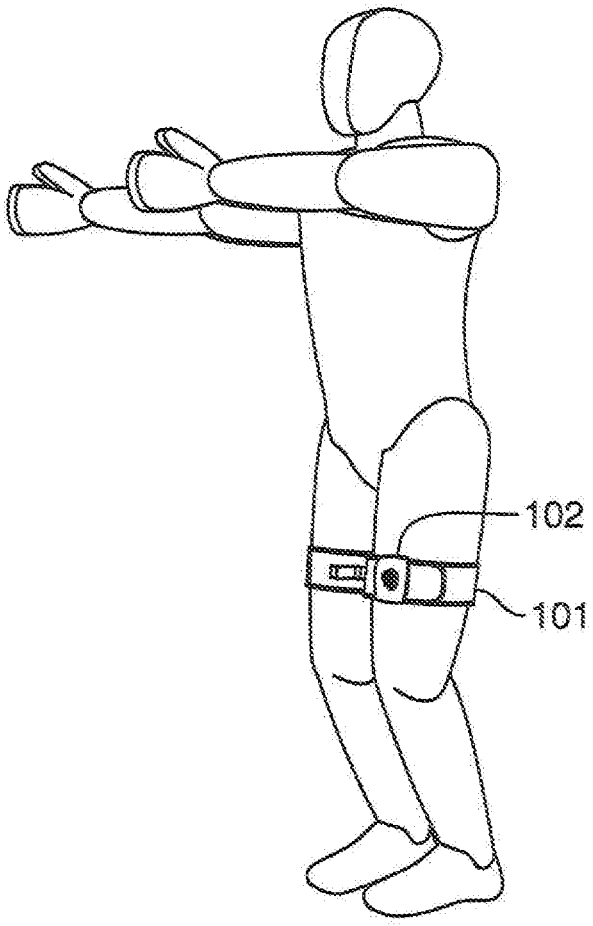
FIG. 2A shows a schematic view of the user in erect position wearing the device according to an embodiment.
Figure 2B:
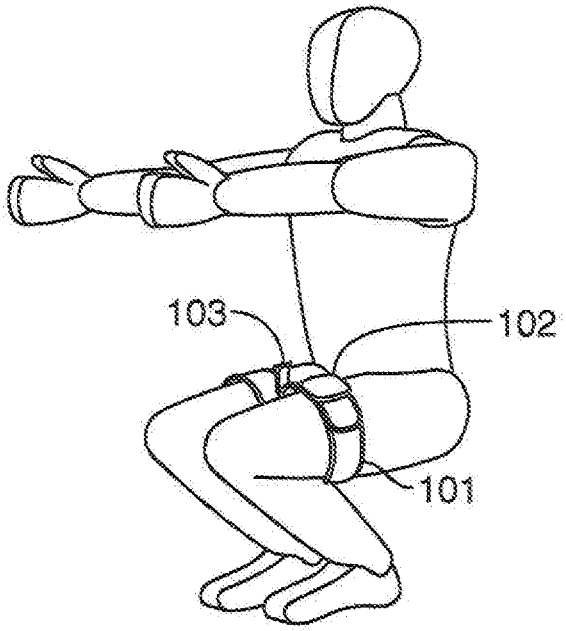
FIG. 2B shows a schematic view of the user in squat position wearing the device according to an embodiment.

FIG. 2A and FIG. 2B shows a schematic view of the user performing squat exercises wearing the device 100 for monitoring and tracking the body movement according to an embodiment. The device 100 is constructed of durable straps 101 that wrap completely around the user's legs at approximately mid-thigh. The leg straps 101 are configured to adjustable to fit a variety of leg sizes providing a comfortable fit. The leg straps 101 are connected to each other by a center strap 103 in order to hold the user's legs parallel. The center strap 103 is also adjustable for different sizes. The electronic squat indicator or electronic housing 102 is attached to one of the leg straps. The indicator measures the angle of the legs traveled utilizing an internal gyroscope.

When the user perform squat exercise, the device 100 senses the accurate squat position and indicate with an audible beep, LED display, or it can be switched to a more discreet vibration mode. The vibration mode is useful for the user wearing headphones, or not wishing to disturb other people. The device 100 is configured to hold the legs in an accurate arrangement and indicate the accurate squat position. The device 100 could also connected to various other devices via Bluetooth linking technology.

Figure 3:
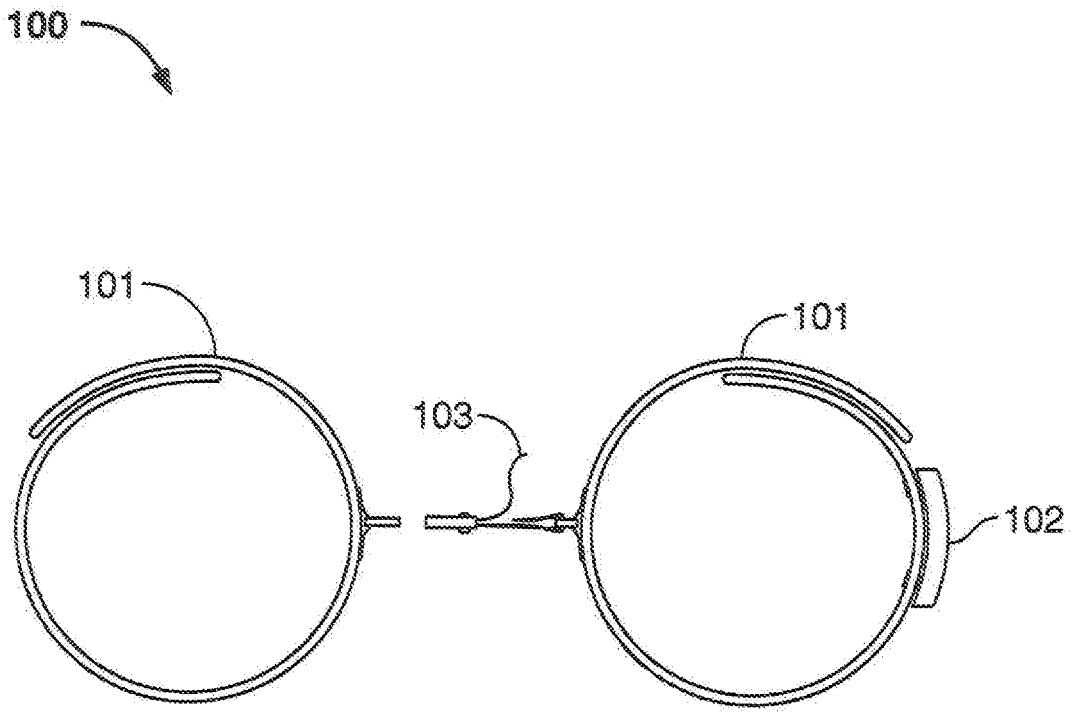
FIG. 3 shows top view of the device for monitoring and tracking the body movement of a user performing squat exercises according to an embodiment.

FIG. 3 shows top view of the device 100 for monitoring and tracking the body movement of a user performing squat exercises according to an embodiment. In an embodiment, the thigh straps 101 are prepared by cutting to a required dimension from a bolt of 600 denier nylon fabric using a computer controlled rolling cutter. After cutting, the fabric is edged using nylon edging which is sewn into place around the strap to create designer look. The edging can complement, match, or contrast with the strap color to enhance the look.

Figure 4:
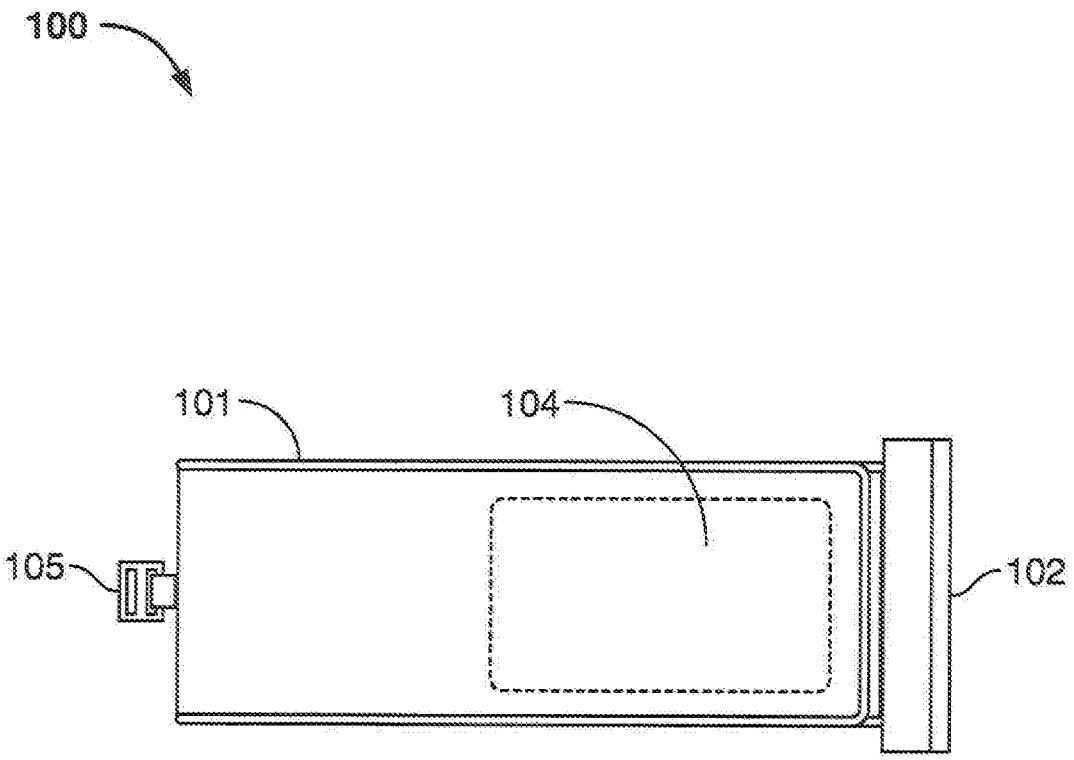
FIG. 4 shows a top view of the thigh strap in the device according to an embodiment.
Figure 5:
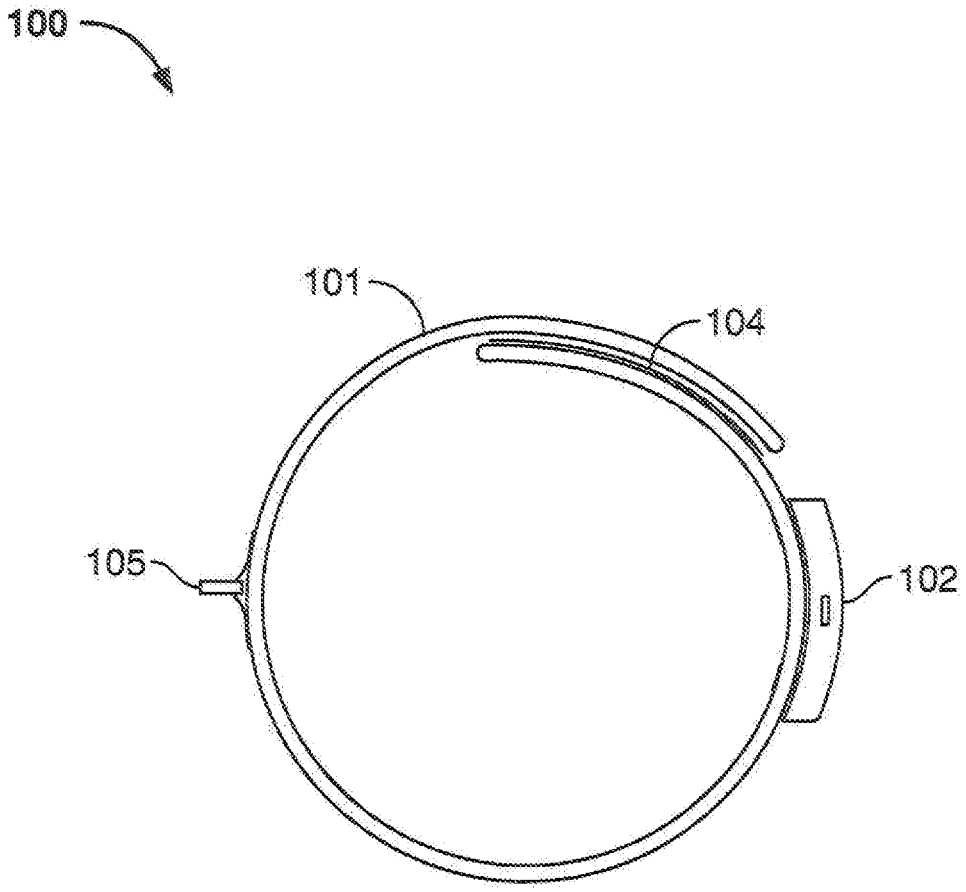
FIG. 5 shows a top view of the thigh strap with controller in the device according to an embodiment.

FIG. 4 shows a top view of the thigh strap 101 in the device 100 according to an embodiment. The nylon strap retainer 104 is sewn to the inner thigh point using a 1" wide woven nylon strap and commercial plastic strap retainer. A side-release buckle receiver 105 is sewn to the inner thigh point on the other strap using a 1" wide woven nylon strap to accept the side release buckle on the adjustable leg separation strap. The thigh straps 101 could be unbuckled to allow the user to move more freely between sets or putting the bands on the legs. The strap 101 configured to fit the legs by using the hook and loop fastener to change the diameter of the thigh straps 101. As an option, the device can be produced in any sizes for children, men, women, or any category. FIG. 5 shows a top view of the thigh strap 101 with controller or electronic housing 102 in the device 100 according to an embodiment. After sewing, the electronic housing 102 is attached, two thigh straps 101 are joined using the buckle and packed for shipment in the point-of-sale packaging.

In one embodiment, the housing 102 for controller are injection molded from polycarbonate plastic. This plastic is very durable, is highly resistant to drop shocks, household and gymnasium chemicals, which is also easy to clean. The housing 102 can be supplied in almost any vibrant color, so a distinctive color may be chosen to enhance the product recognition factor, which can dramatically improve the market adoption of the product. The housing 102 comprises two sections, which could snap together to protect the electronics, and retained using stainless steel fasteners. The assembled and tested housing 102 is secured to the thigh strap 101 using aluminum rivets.

Figure 6:
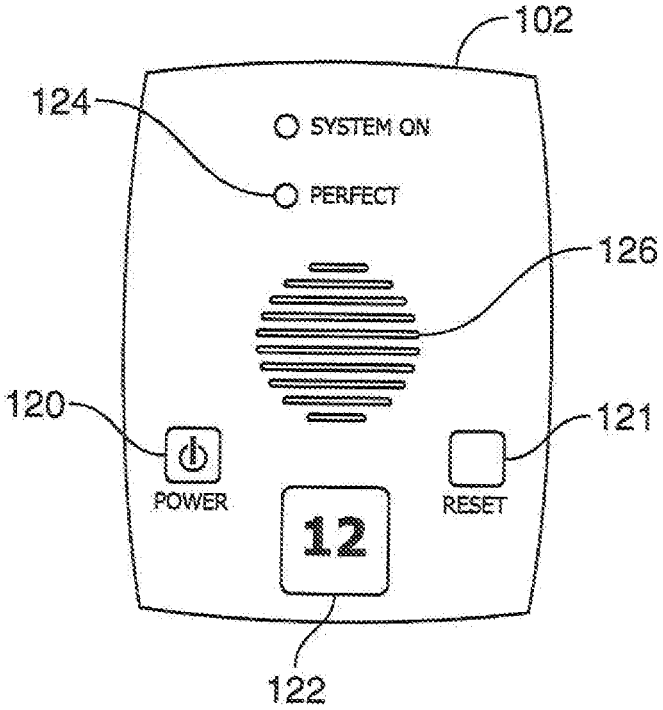
FIG. 6 shows a schematic view of the controller implemented the device according to an embodiment.
Figure 7:
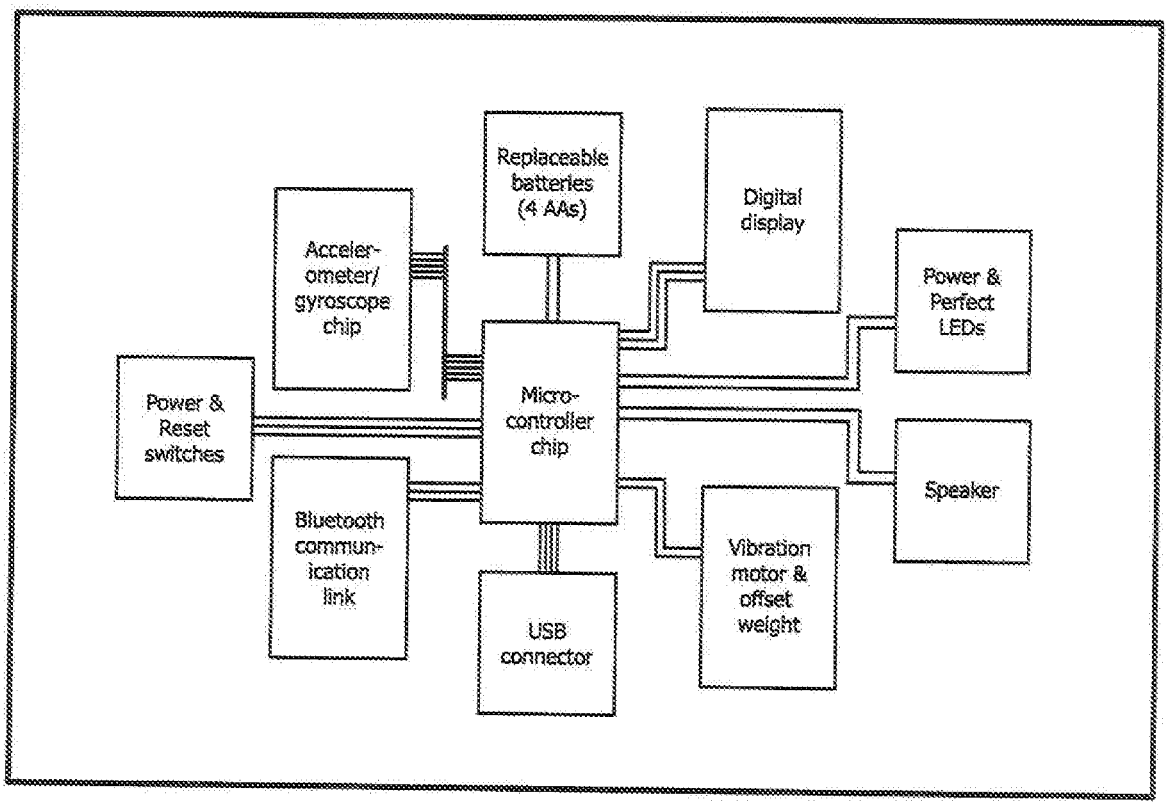
FIG. 7 shows a block diagram of the controller in the system for monitoring and tracking the body movement of a user performing squat exercises according to an embodiment.

FIG. 6 shows a schematic view of the controller or electronic housing 102 implemented the device 100 according to an embodiment. The printed circuit boards (PCB) in the housing 102 comprises an actuating device, an accelerator or a gyroscope, a communication link, a power source, a processor, an USB connector, and an alerting device. FIG. 7 shows a block diagram of the controller in the system for monitoring and tracking the body movement of a user performing squat exercises according to an embodiment. In one embodiment, the actuating device is one or more power switches 120 and reset switches 121. In one embodiment, the communication link is a Bluetooth communication link. In one embodiment, the power source is a replaceable or a rechargeable battery. In one embodiment, the processor is a microcontroller chip, and the alerting device is one or more of digital display 122, vibration motor, alert LEDs 124 or speaker 126.

In an embodiment, the digital display 122 is a liquid crystal device with a backlight and a monochromatic display. The pixilated display 122 can display up to 999, which should encompass even the most dedicated exerciser's capabilities. In one embodiment, vibration motor is an offset weighted DC motor. It operates at 11,000 RPM and creates a very distinctive vibration, which is transmitted directly to the outer thigh when the optimum angle is obtained. In one embodiment, the alert LEDs 124 are placed to project from PCB out through the polycarbonate lenses in the controller housing 102. In an embodiment, the speaker 126 comprises a digital to analog converter, allows the controller 102 to produce a tone, other sounds, or even synthesized words as an alerting function.

In one embodiment, the PCB for the controller 102 is fabricated to the final design requirements. The standard thickness, double-sided circuit board material is populated with surface mounted components. Any through-hole devices are inserted after the surface mounted assembly, soldering, and cleaning. The circuit board is designed to have all the components oriented so they can be mounted with the LED illuminators projecting out of the lenses mounted in the housings 102. After assembly, the PCBs are protected with a moisture adsorption preventive conformal coating.

In an embodiment, the power switches 120 and reset switches 121 are sealed tactile membrane switches to have a prominent product life cycle. In one embodiment, accelerometer and gyroscope is a chip measuring the angle from erect, and the thigh strapped with the controller reaches 90° from vertical and parallel to the floor, the controller engages the alert function. The accelerometer and gyroscope work in tandem to optimize the motion discrimination.

In an embodiment, the Bluetooth communication link is a chip allowing bi-lateral communication with an electronic device such as smartphone or wireless headphones/ear buds. It sends alert signals to the appropriate linked device selected by the user. In one embodiment, the controller 102 is operated using four AA batteries. In one embodiment, the microcontroller chip is a microprocessor with 1 GHz snapdragon or equal. It is a low power consumption device and has enough power to operate all the functions required by the device with computing power to spare. In one embodiment, the USB connector allows the user to cable a laptop to the exercise controller for updates or to reprogram the device.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. An exercise product for obtaining and maintaining an optimum positioning for a repeating squat exercise, comprising:

two bands of nylon configured to encircle the upper thighs of a user;

two adjustable length straps, each strap having a first end and a second end, wherein the first end of each strap is connected to one of the bands and the second ends of each strap are configured to be releasably buckled to each other, whereby the straps when buckled together are operable to keep the thighs spaced properly during the exercise set; and an electronic module attached to one of the bands that continuously measures an angle of the user's thighs and keeps count of the repetitions of the exercise.

2. The exercise device of claim 1, wherein each band comprises a molded nylon strap retainer sewn to the leg band using a 1" wide woven nylon strap.

3. The exercise device of claim 1, wherein each band comprises 600 denier nylon fabric which is cut to width, and edging which is sewn on all around the band to make a finished edge.

4. The exercise device of claim 3, wherein the bands and the edging are formed with contrasting colors.

5. The exercise device of claim 1, wherein each band comprises hook and loop fasteners configured to allow adjustment of the diameter of the band when worn.

6. The exercise device of claim 1, wherein the electronic module comprises a controller which uses LEDs, sound, and vibration to guide the user.

7. The exercise device of claim 6, wherein the electronic module comprises switches configured to control the operation of the module and reset the count of the repetitions at the end of each set of exercises.

8. The exercise device of claim 6, wherein the electronic module comprises a first LED which is configured to light when the system is turned on, and a second LED which is configured to light when the exercise is performed correctly.

9. The exercise device of claim 8, wherein the electronic module is further configured to emit an audible tone and a vibration alert when the exercise is performed correctly.

10. The exercise device of claim 1, wherein the electronic module comprises a housing which is molded from durable plastic and curved to fit a leg of a user.

11. The exercise device of claim 1, wherein the electronic module comprises an accelerometer/gyroscope chip which is configured to measure an angle of a user's leg and alerts the user when the traveled angle equals 90 degrees.

12. The exercise device of claim 1, wherein the electronic module comprises a speaker which is configured to emit a tone when 90 degrees is reached, and is configured to be programmed to speak encouraging phrases.

13. The exercise device of claim 1, wherein the electronic module comprises battery hatches and a USB connector.

14. The exercise device of claim 1, wherein the electronic module comprises a Bluetooth communication link.

15. The exercise device of claim 1, wherein the electronic module comprises replaceable batteries.

16. The exercise device of claim 1, wherein the electronic module comprises a microcontroller chip.

17. The exercise device of claim 1, wherein the electronic module comprises a digital display.

18. The exercise device of claim 1, wherein the electronic module comprises an offset weighted vibration motor.

* * * * *